US006297489B1

(12) United States Patent
Suyama et al.

(10) Patent No.: US 6,297,489 B1
(45) **Date of Patent: *Oct. 2, 2001**

(54) ELECTRON TUBE HAVING A PHOTOELECTRON CONFINING MECHANISM

(75) Inventors: Motohiro Suyama; Suenori Kimura; Tetsuya Saito; Tetsuya Morita, all of Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/192,516

(22) Filed: Nov. 17, 1998

Related U.S. Application Data

(63) Continuation-in-part of application No. 08/847,259, filed on May 1, 1997, now Pat. No. 5,874,728.

(30) Foreign Application Priority Data

May 2, 1996 (JP) ..... 8-111656
May 23, 1996 (JP) ..... 8-128723

(51) Int. Cl.[7] ..... H01J 43/12

(52) U.S. Cl. ..... 250/207; 250/214 VT; 313/532; 313/541

(58) Field of Search ..... 250/207, 214 VT, 250/333, 370.01, 370.08, 370.09, 370.11, 370.14; 313/532, 533, 534, 537, 538, 540, 541, 542, 544, 103 R, 106, 523, 529, 530, 524, 525, 527, 528

(56) References Cited

U.S. PATENT DOCUMENTS 3,705,321 12/1972 Wolfgang .
3,764,841 * 10/1973 Coon ..... 313/153
3,787,745 1/1974 Wulms .
4,315,184 2/1982 Santilli et al. .

(List continued on next page.)

FOREIGN PATENT DOCUMENTS 0 602 983 6/1994 (EP) .
0 820 089 1/1998 (EP) .
57-46453 3/1982 (JP) .
6-243795 9/1994 (JP) .
6-318447 11/1994 (JP) .
8-148113 6/1996 (JP) .

OTHER PUBLICATIONS

Suyama, et al., "A Compact Hybrid Photodetector (HPD)", IEEE Transactions on Nuclear Science, vol. 44, No. 3, Jun. 1997, pp. 985–989.

Suyama, et al., "A Hybrid Photodetector (HPD) With a III–V Photo–cathode", IEEE Transactions on Nuclear Science, vol. 45, No. 3, Jun. 1998, pp. 572–575.

(List continued on next page.)

*Primary Examiner*—John R. Lee
(74) *Attorney, Agent, or Firm*—Pillsbury Winthrop LLP

(57) ABSTRACT

This invention relates to an electron tube having a structure for enabling a stable operation for a long time. In the electron tube, at least a confining mechanism is arranged between a photocathode and the electron incident surface of a semiconductor device, which are arranged to oppose each other. In the arrangement, the area of the opening of the confining mechanism is at least equal to or smaller than that of the electron incident surface, thereby confining the orbits of photoelectrons from the photocathode. This structure avoids bombardment of electrons arriving at portions other than the electron incident surface of the semiconductor device and prevents the semiconductor device from being unnecessarily charged.

16 Claims, 10 Drawing Sheets

U.S. PATENT DOCUMENTS

| | | | | |
|---|---|---|---|---|
| 4,422,008 | * | 12/1983 | Aramaki et al. | 313/524 |
| 5,120,949 | | 6/1992 | Tomasetti . | |
| 5,146,296 | | 9/1992 | Huth . | |
| 5,155,349 | | 10/1992 | Roehrich et al. . | |
| 5,177,350 | * | 1/1993 | Beauvars et al. | 250/214 VT |
| 5,374,826 | | 12/1994 | Larue et al. . | |
| 5,475,227 | | 12/1995 | Larue . | |
| 5,654,536 | * | 8/1997 | Suyama et al. | 250/207 |
| 5,780,967 | * | 7/1998 | Suyama et al. | 313/541 |
| 5,874,728 | * | 2/1999 | Suyama et al. | 250/207 |
| 5,883,466 | * | 3/1999 | Suyama et al. | 313/542 |
| 5,917,282 | * | 6/1999 | Suyama et al. | 313/544 |
| 5,986,387 | * | 11/1999 | Niigaki et al. | 313/103 R |
| 6,002,141 | * | 12/1999 | Niigaki et al. | 257/10 |
| 6,008,579 | * | 12/1999 | Negi et al. | 313/532 |
| 6,020,684 | * | 2/2000 | Negi et al. | 313/544 |

OTHER PUBLICATIONS

Patent Abstracts of Japan vol. 095, No. 002, Mar. 31, 1995 & JP 06 318447 A(Hamamatsu Photonics KK), Nov. 15, 1994.

G.A. Johansen, "Operational characteristics of an electron–bombarded silicon–diode photomultiplier tube", Nuclear Instruments & Methods in Physics Research, 1993, pp. 295–298, (No Month Provided).

Fertin et al., "Reverse Epitaxial Silicon Diode for Hybrid Photomultiplier Tube", IEEE Trans. Nucl. Sci., NS–15, 1968, pp. 179–189, (No Month Provided).

Geest et al., "Hybrid phototube with Si target", Nuclear Instruments and Methods in Physics Research, 1991, pp. 261–266 (No Month Provided).

Basa et al., "Test results of the first Proximity Focused Hybrid Photodiode Detector prototypes", Nuclear Instruments & Methods in Physics Research, 1993, pp. 93–99, (No Month Provided).

* cited by examiner

ELECTRON TUBE HAVING A PHOTOELECTRON CONFINING MECHANISM

RELATED APPLICATIONS

This is a continuation-in-part of application Ser. No. 08/847,259 filed on May 1, 1997, now U.S. Pat. No. 5,874,728.

BACKGROUND OF THE INVENTION

1. Field of the Invention

The present invention relates to an electron tube used as a photodetector for quantitatively measuring weak light and particularly having a sensing device such as a semiconductor device for multiplying photoelectrons emitted from a photocathode and outputting the electric signals.

2. Related Background Art

Conventionally, an electron tube which causes an electron lens to accelerate and focus photoelectrons emitted from a photocathode upon incidence of light and makes the photoelectrons incident on, e.g., a semiconductor device to obtain a high gain is known. This electron tube is disclosed in, e.g., U.S. Pat. No. 5,120,949, Japanese Patent Laid-Open No. 6-318447, U.S. Pat. No. 5,374,826 or 5,475,227. Particularly, U.S. Pat. No. 5,475,227 discloses a structure for preventing a phenomenon that ions generated from gas molecules adsorbed on the electron incident surface of the semiconductor device due to electrons incident on the semiconductor device are accelerated and fed back to the photocathode to result in a large degradation in photocathode. More specifically, a semicylindrical ion deflecting electrode is arranged immediately before the semiconductor device to bend the orbits of ions generated on the electron incident surface of the semiconductor device, thereby preventing the ions from returning to the photocathode.

SUMMARY OF THE INVENTION

The present inventors examined the prior arts and found the following problems. In the prior art disclosed in U.S. Pat. No. 5,472,227, ions generated from the semiconductor device are bent in orbit and prevented from being fed back to the photocathode. With this structure, although the photocathode can be prevented from degrading, the ions bent in orbit collide with the insulating side wall, so no stable operation can be obtained. This is because secondary electrons are emitted from the insulating side wall of the container upon collision of ions to charge the side wall to a positive potential, thus affecting the orbits of electrons propagating from the photocathode to the semiconductor device. Particularly, with the arrangement of each prior art, only a specific portion of the side wall of the container is charged upon collision of ions to make the electron lens asymmetric. Therefore, the orbits of electrons are largely bent. In addition, the secondary electrons generated upon collision of ions are incident on the semiconductor device to generate a pseudo signal or stray to produce a new unstable state.

An object of the present invention is to provide an electron tube having a structure for enabling a stable operation for a long time.

In accordance with the present invention, there is provided an electron tube comprising, at least, a photocathode arranged so as to emit photoelectrons in correspondence with incident light, a semiconductor device having an electron incident surface for receiving the photoelectrons from the photocathode, the electron incident surface being arranged so as to face the photocathode, and a confining mechanism arranged between the photocathode and the electron incident surface to confine orbits of the photoelectrons from the photocathode. Particularly, the confining mechanism has an opening which contributes to confine the spread of the photoelectrons (the photoelectrons from the photocathode pass through this opening and arrive at the electron incident surface of the semiconductor device). The area of the opening is set to be equal to or smaller than that of the electron incident surface of the semiconductor device. Therefore, the opening of the confining mechanism is arranged at a position close to the electron incident surface.

A container of the electron tube according to present invention can be selected from at least one of a pipe type having first and second openings, envelope type having one opening, and the like. In the pipe type container, the photocathode is arranged on the first opening side thereof, and a conductive stem is arranged on the second opening side thereof. The stem functions to define a distance between the photocathode and the electron incident surface of the semiconductor device. And the confining mechanism is positioned between the photocathode and the semiconductor device while being accommodated in the pipe type container. On the other hand, in the envelope type container, the photocathode is arranged on the opening thereof, and the semiconductor device is mounted on an inner bottom surface of the envelope type container.

The electron tube further comprises an electron lens constituted by a cathode electrode arranged so as to apply to the photocathode and having a through hole for passing the photoelectrons from the photocathode toward the electron incident surface, and an anode electrode arranged between the photocathode electrode and the electron incident surface of the semiconductor device. In the pipe type container, the cathode electrode is arranged on the first opening side of the container. In the envelope type container, the cathode electrode is arranged as a conductive film on an inner wall of the container. The anode electrode has a first surface facing the photocathode, a second surface opposing the first surface, and a through hole extending from the first surface to the second surface.

In this arrangement, the confining mechanism includes the anode electrode, and the opening of the confining mechanism corresponds to a second-surface-side opening of the through hole of the anode electrode. In other words, the opening having smallest area within the openings of the electron lens corresponds to the opening of the confining mechanism.

In this electron tube, external light is converted into electrons by the photocathode. The electrons (photoelectrons) emitted from the photocathode pass through the through hole of the anode electrode and then arrive at the electron incident surface of the semiconductor device. At this time, positive ions are generated on the electron incident surface. The anode electrode is set at a positive potential with respect to the electron incident surface of the semiconductor device. Since the anode electrode is reverse-biased with respect to the positive ions generated on the electron incident surface, the generated positive ions cannot return to the photocathode or case through the through hole of the anode electrode.

In this case, preferably, a cylindrical collimator portion extending toward the photocathode is arranged on the first surface of the anode electrode concentrically with the first-surface-side opening of the through hole of the anode electrode. When the collimator portion is arranged on the anode electrode in use of the semiconductor device (e.g., an avalanche photodiode: APD), extension of the electric field from the photocathode toward the semiconductor device through the through hole of the anode electrode can be minimized. Therefore, ion feedback can be effectively suppressed.

More preferably, a conductive mesh electrode is arranged in the through hole of the anode electrode. When the mesh electrode is arranged in the anode electrode in use of the semiconductor device (e.g., a photodiode: PD), extension of the electric field from the photocathode toward the semiconductor device through the through hole of the anode electrode can be minimized. Therefore, ion feedback can be effectively suppressed.

The electron tube according to the present invention may further comprise a collimator electrode supported by the anode electrode. The collimator electrode has a third surface facing the photocathode, a fourth surface opposing the third surface, and a through hole extending from the third surface to the fourth surface. The confining mechanism includes the collimator electrode, and the opening of the confining mechanism corresponds to a fourth-surface-side opening of the through hole of the collimator electrode. The orbits of the photoelectrons incident from the photocathode on the third-surface-side opening of the collimator electrode at a predetermined angle are collimated by the collimator electrode, and its spread is confined by the collimator electrode. The photoelectrons which have passed through the collimator electrode are incident on the electron incident surface along the normal of the electron incident surface. When the collimator electrode is arranged, arrival of the photoelectrons at portions other than the electron incident surface is effectively suppressed.

The semiconductor device has an n-type substrate and a p-type semiconductor layer formed on the n-type semiconductor substrate and having the electron incident surface. In the semiconductor device, the n-type semiconductor substrate and the anode electrode are set at a same potential.

In general, the semiconductor device has an incident surface electrode in order to apply to the electron incident surface with a predetermined voltage. The electron incident surface is defined by an opening of the incident surface electrode. The semiconductor device further has a peripheral electrode provided so as to surround the incident surface electrode. The peripheral electrode has to be set a different potential such a grounded level. Necessarily, since the incident surface electrode is apart from the peripheral electrode by a predetermined distance, a part of the insulating layer of the semiconductor device is exposed from a gap therebetween.

In order to prevent the photoelectrons from reaching the gap, it is preferable that the maximum inner diameter of the opening of the confining mechanism is equal to or smaller than the minimum outer diameter of the incident surface electrode. The minimum outer diameter of the incident surface electrode is defined by the minimum distance between intersections where a line passing through the center of the electron incident surface intersects an outer edge of the incident surface electrode.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will be apparent to those skilled in the art from this detailed description.

BRIEF DESCRIPTION OF THE DRAWINGS

FIG. 4A is a view for explaining the structural relationship between the electron incident surface of the semiconductor device and the opening of a confining mechanism; whereas

FIG. 6A is a sectional view of the electron tube (second embodiment) shown in FIG. 5 taken along a line II—II in FIG. 5; whereas

DESCRIPTION OF THE PREFERRED EMBODIMENTS

The embodiments of an electron tube according to the present invention will be described below with reference to FIGS. 1–3, 4A–4B, 5, 6A–6B, 7–12.

Figure 1:
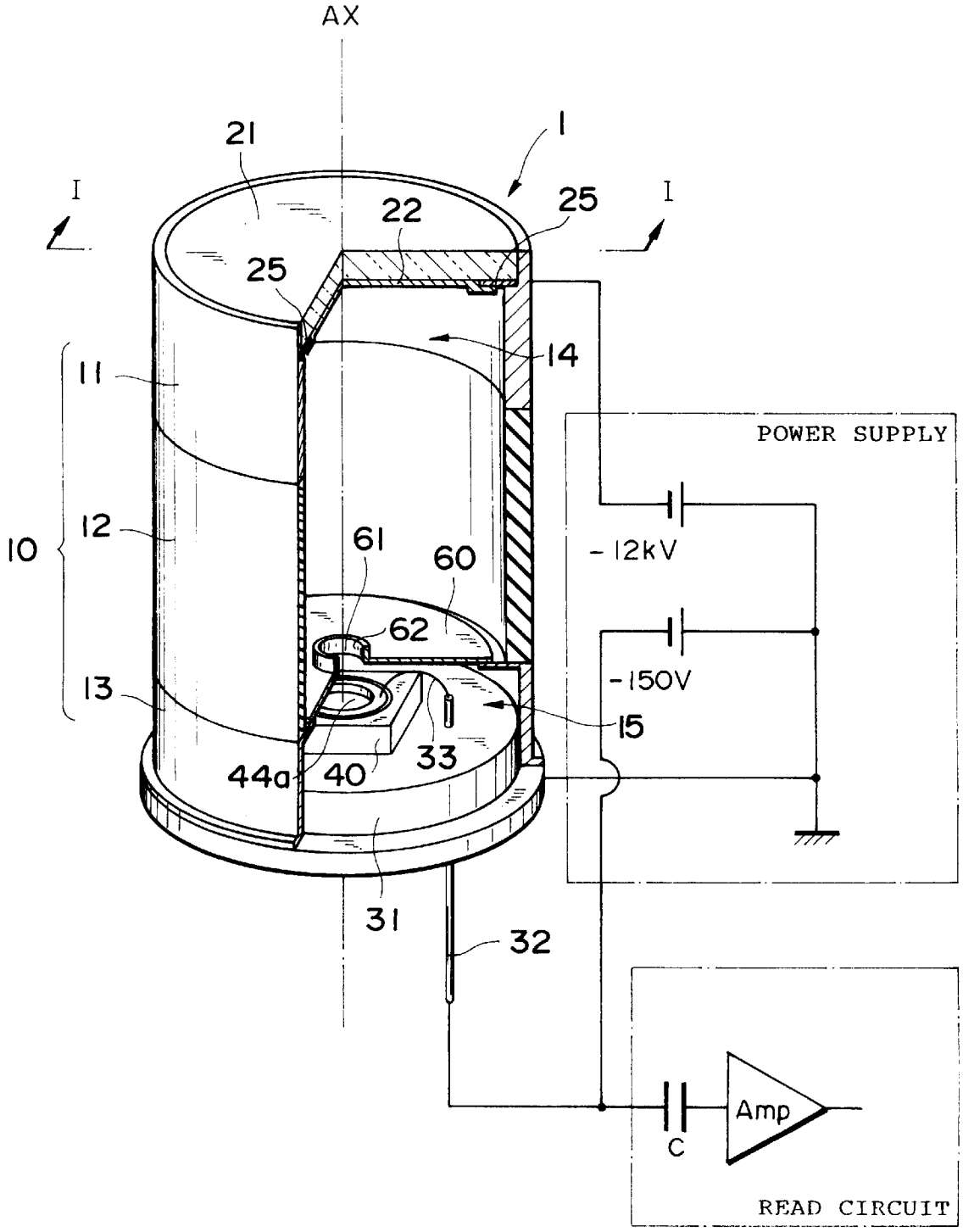
FIG. 1 is a perspective view (partially cutaway view) showing the structure of an electron tube according to the first embodiment of the present invention, in which the structures of main parts of the electron tube are common to the first to fourth embodiments.
Figure 2:
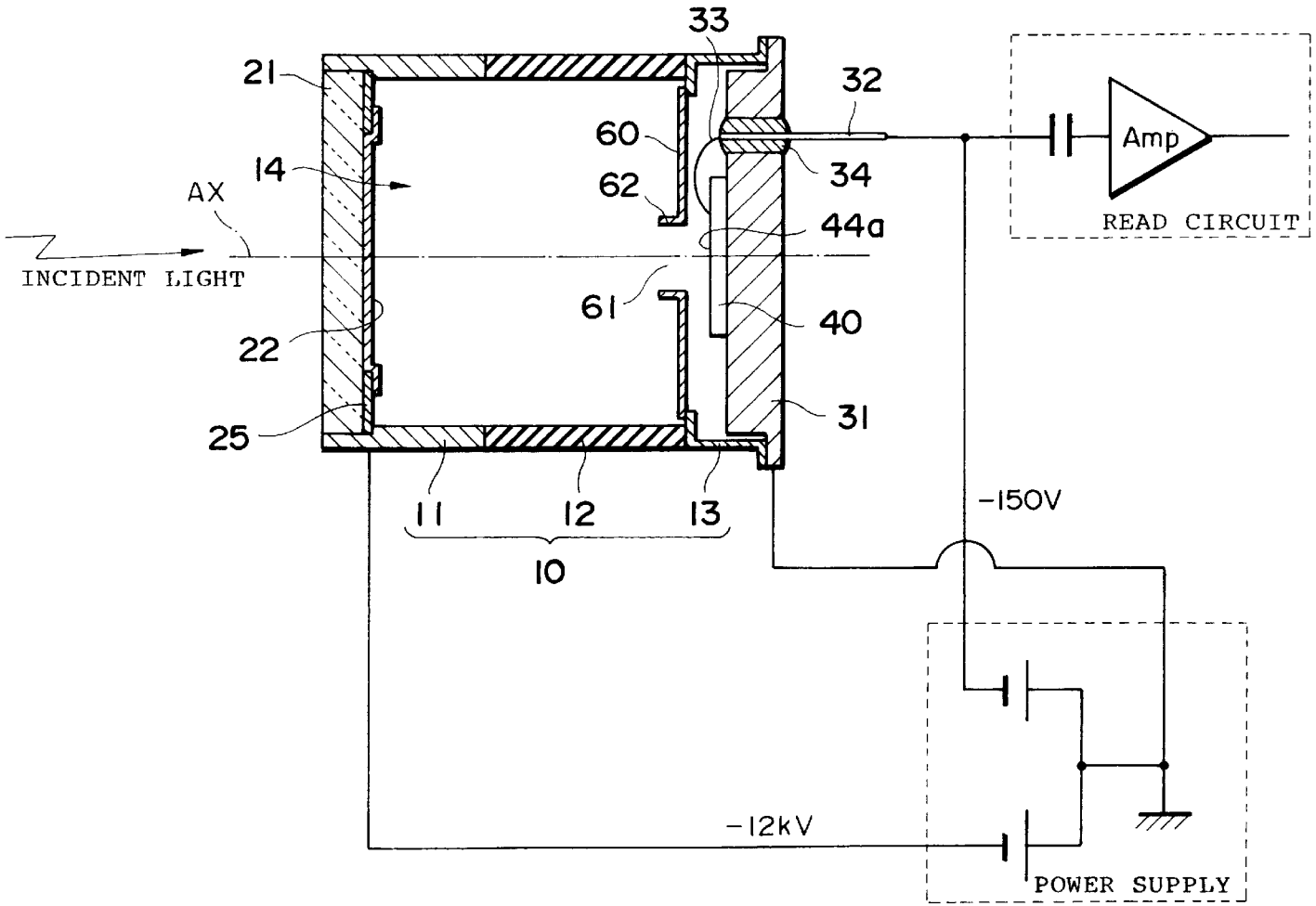
FIG. 2 is a sectional view of the electron tube (first embodiment) shown in FIG. 1 taken along a line I—I in FIG. 1.

FIGS. 1 and 2 are a perspective view and a sectional view, respectively, showing an electron tube according to the first embodiment of the present invention. Particularly, the sectional view in FIG. 2 shows the section of the electron tube taken along a line I—I in FIG. 1. Referring to FIGS. 1 and 2, an electron tube 1 has a cylindrical case 10. The case 10 is constituted by a hollow cylindrical cathode electrode 11 of a Kovar metal and a welded flange portion 13, which are respectively fixed at two ends of a ceramic portion 12 (included in a pipe type container) extending along an axis AX to sandwich the ceramic portion 12. The cathode electrode 11, the ceramic portion 12, and the welded flange portion 13 are integrated by brazing. In consideration of an electron lens (to be described later), when the case 10 has an outer diameter of 15 mm, an inner diameter of 12 mm, and a total length of 13 mm, the length of the cathode electrode 11 is preferably 5 mm.

An input surface plate (face plate) 21 made of glass to transmit light is fixed to the cathode electrode 11 of the case 10. The face plate 21 has a photocathode 22 (photoelectric surface) inside and is arranged on the side of a first opening 14 of the case 10. After the photocathode 22 is formed, the face plate 21 is fixed to the cathode electrode 11 while the photocathode 22 and the cathode electrode 11 are electrically connected via a photocathode electrode 25 consisting of a chromium thin film. The photocathode electrode 25 has an inner diameter of 8 mm, with which the effective diameter of the photocathode electrode 25 is defined.

A disk-shaped stem 31 of a conductive material (e.g., a Kovar metal) is fixed to the welded flange portion 13 of the case 10. The stem 31 is arranged on the side of a second opening 15 of the case 10. A lead pin 32 insulated by glass 34 is fixed to the stem 31. The peripheral portion of the stem 31 is resistance-welded to the welded flange portion 13 and integrated with the case 10. Therefore, the electron tube 1 is constituted by integrating the case 10, the face plate 21, and the stem 31, and a predetermined vacuum state is held in the electron tube 1.

Figure 3:
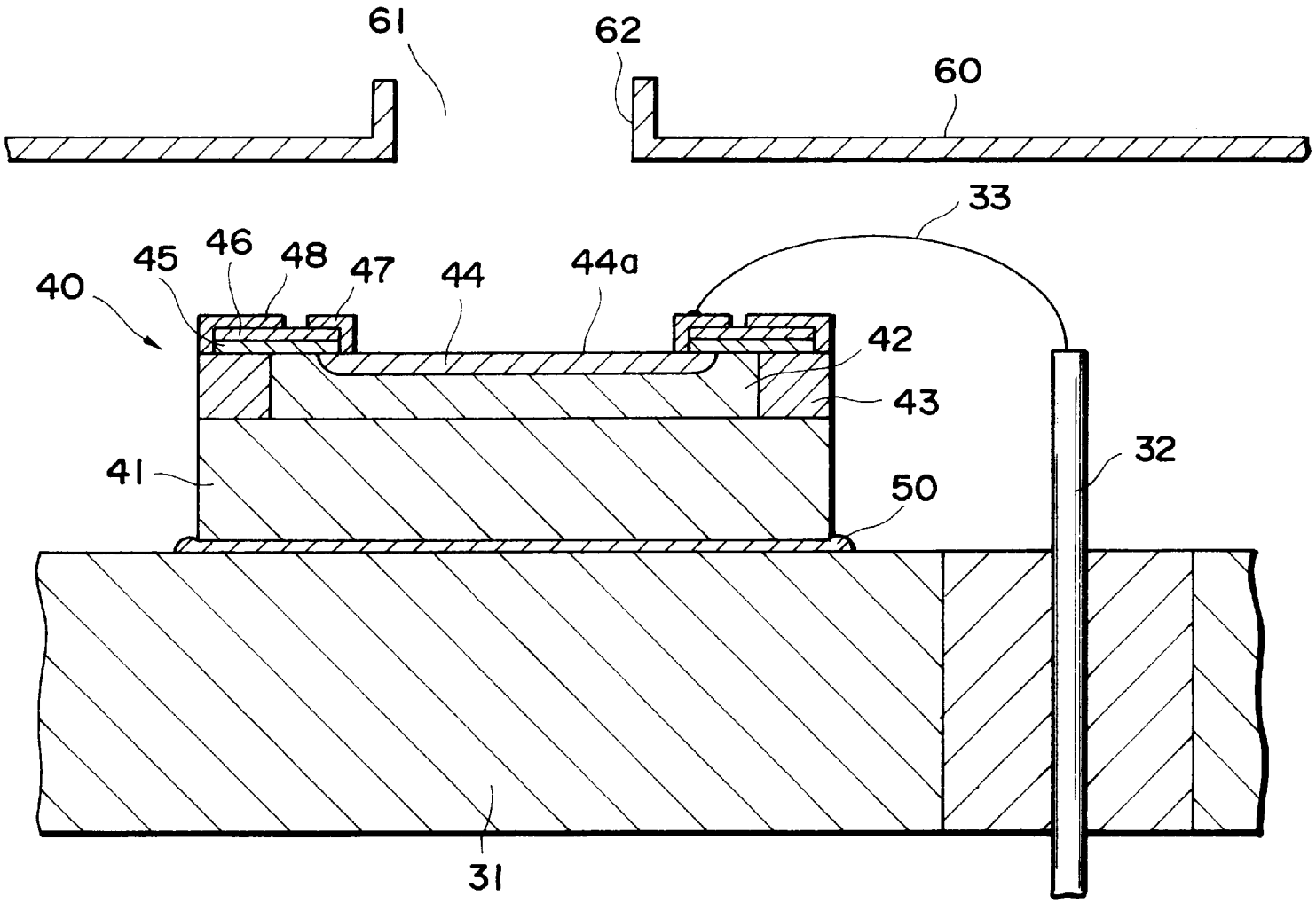
FIG. 3 is a sectional view showing a detailed structure near a semiconductor device in the electron tube shown in FIG. 2.

As shown in FIG. 3, a semiconductor device 40 operating as an APD (Avalanche PhotoDiode) is fixed on the surface of the stem 31 on the photocathode side with a conductive adhesive 50. The semiconductor device 40 uses a substrate 41 formed of heavily doped n-type silicon as a substrate material. A disk-shaped p-type carrier multiplication layer 42 is formed at the central portion of the substrate 41. A guard ring layer 43 consisting of a heavily doped n-type semiconductor and having the same thickness as that of the carrier multiplication layer 42 is formed outside the carrier multiplication layer 42. A breakdown voltage control layer 44 of a heavily doped p-type semiconductor is formed on the surface of the carrier multiplication layer 42. The surface of the breakdown voltage control layer 44 serves as an electron incident surface 44*a*. An oxide film 45 and a nitride film 46 are formed to connect the peripheral portion of the breakdown voltage control layer 44 to the guard ring layer 43. To apply an anode potential to the breakdown voltage control layer 44, an incident surface electrode 47 is formed on the outermost surface of the semiconductor device 40 by depositing aluminum into an annular shape. A peripheral electrode 48 rendered conductive with the guard ring layer 43 is also formed on the outermost surface of the semiconductor device 40. The peripheral electrode 48 is separated from the incident surface electrode 47 by a predetermined interval. The diameter of the electron incident surface 44*a* is preferably 3 mm inside the incident surface electrode 47.

The silicon substrate 41 of the semiconductor device 40 is fixed to the stem 31 with the conductive adhesive 50. The stem 31 and the silicon substrate 41 are electrically connected to each other by using the conductive adhesive 50. The incident surface electrode 47 of the semiconductor device 40 is connected to the lead pin 32 insulated from the stem 31 through a wire 33.

As shown in FIGS. 1 to 3, a plate-like anode electrode 60 is arranged between the semiconductor device 40 and the photocathode 22. The anode electrode 60 is fixed to the welded flange portion 13 and positioned near the semiconductor device 40. The distance between the anode electrode 60 and the semiconductor device 40 is preferably 1 mm. A through hole 61 (a confining mechanism for confining the photoelectrons in orbit) for passing photoelectrons from the photocathode 22 toward the electron incident surface 44*a* of the semiconductor device 40 is formed at the central portion of the anode electrode 60. A cylindrical collimator portion (servicing as a collimator electrode) 62 projecting to the photocathode side is integrated with the anode electrode 60 to surround the through hole 61. The collimator portion 62 projects toward the photocathode 22 and is arranged to surround the photoelectric-surface-side opening of the through hole 61. The through hole 61 has a diameter of 2 mm. The collimator portion 62 has an inner diameter of 2 mm and a height of 1 mm.

Figure 4A:
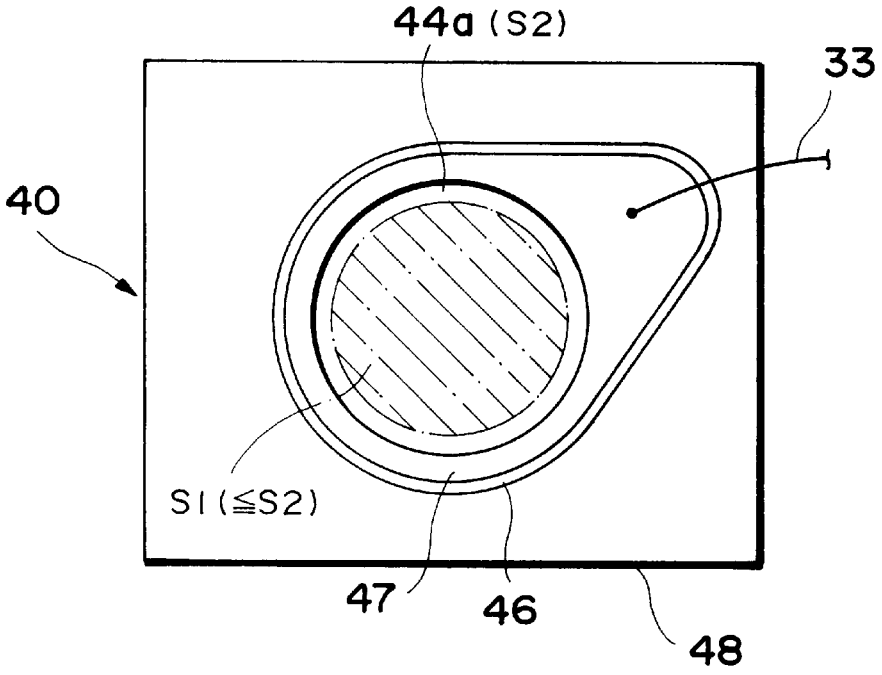

As shown in FIG. 4A, the effective area of the electron incident surface 44*a* is limited by the collimator electrode 62 to an area S1 (the area S1 matches the area of the stem-side opening of the through hole 61 of the anode electrode 60) equal to or smaller than that (S2) of the electron incident surface 44*a*. More specifically, in this embodiment, the diameter of the electron incident surface 44*a* capable of receiving incident electrons is 3 mm, as described above. However, the diameter of a region on which electrons can actually be incident is limited to about 2 mm. On the other hand, as allowing that a part of the photoelectrons passing through the collimator portion 62 arrive at the metal electrode 47, the area S1 of the through hole 61 may be equal to the area S2 of the electron incident surface 44*a*. Because the electrode 47 can be absorb the photoelectrons arriving at the electrode 47.

The diameter of the through hole 61 of the anode electrode 60 is made equal to or smaller than that of the electron incident surface 44*a* such that incidence of electrons on the unnecessary portion, i.e., the peripheral portion of the electron incident surface 44*a* of the semiconductor device 40 does not charge the oxide film 45 or nitride film 46, or does not damage the p-n junction interface or the contact face between the semiconductor layer 44 and the metal electrode 47 to degrade the device characteristics. The collimator portion 62 is added to the anode electrode 60 such that extension of the electric field from the photocathode 22 toward the semiconductor device 40 through the through hole 61 is minimized, and the effect of suppressing ion feedback (to be described later) is increased. The collimator portion 62 functions to return the direction of electrons which are emitted from the peripheral portion of the photocathode 22 to be obliquely incident on the semiconductor device 40 to the vertical direction. Electrons obliquely incident on the semiconductor device 40 cross the larger dead layer (the upper layer portion of the breakdown voltage control layer 44) of the semiconductor device 40, so the ratio of incident electrons reaching the depletion layer lowers to decrease the multiplication gain. By adding the collimator portion 62 to correct the orbits of electrons, variations in multiplication gain depending on the electron emission position are suppressed. The anode electrode 60 is formed by pressing a 0.3-mm thick stainless steel plate. The anode electrode 60 may be integrated with the welded flange portion 13.

Figure 4B:
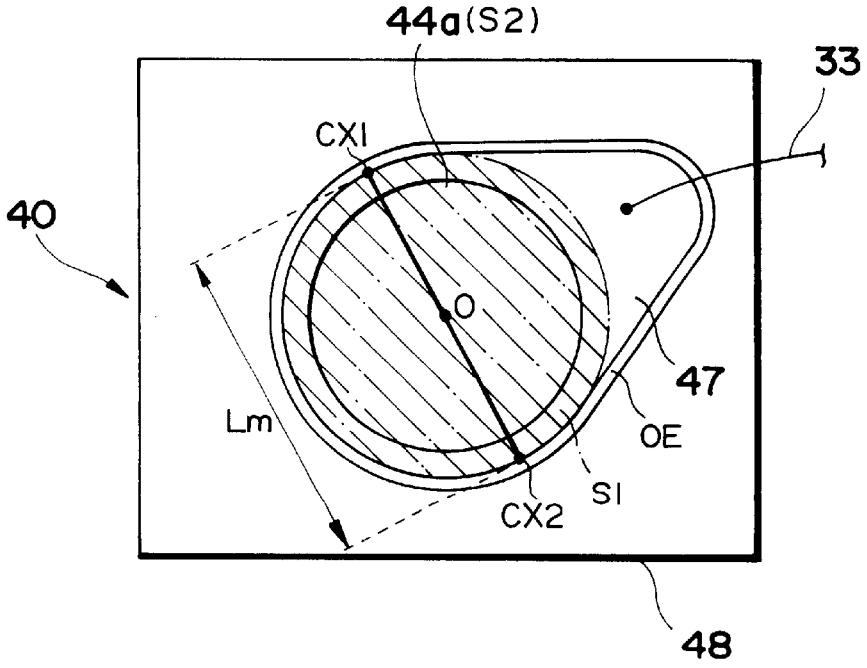
FIG. 4B is a view for explaining the structural relationship between the incident surface electrode and the opening of a confining mechanism.

Further, as shown in FIG. 4A, the incident surface electrode 47 is apart from the peripheral electrode 48 through a gap because the electrodes 47 and 48 of aluminum film are set potentials different from each other. Necessarily, the nitride film 46 is exposed from the gap. The photoelectrons that arrive at the electron incident surface 44*a* are used as a signal after multiplication in the semiconductor device 40, and the photoelectrons that arrive at the incident electrode 47 are absorbed by the electrode 47. By contrast, the photoelectrons that arrive at the nitride film 46 (insulator) between the electrodes 47 and 48 causes charge of the nitride film 46 or the oxide film 45, or causes damage to the interface between the oxide film 45 and the layer 42. When the semiconductor device 40 is reverse-biased, the carrier multiplication layer 42 positioned under the gap is depleted. In this case, if the nitride film 46 or the like is charged or the interface between the oxide film 45 and the layer 42 is damaged, dark current would remarkably increases. Specifically, the damage of the interface can not be ignored. Therefore, it is necessary that the inner diameter of the collimator portion 61 of the anode electrode 60 is set equal to or smaller than the minimum outer diameter of the incident surface electrode 47 in order to prevent that undesirable photoelectrons arrive at the gap. More specifically, the minimum outer diameter of the incident surface electrode 47 is defined by the minimum length of a line passing through the center of the electron incident surface 44*a*. In other words, the minimum outer diameter of the incident surface electrode 47 is, as shown in FIG. 4B, defined by the minimum distance Lm between intersections CX1 and CX2 where the line passing through the center O of the electron incident surface 44*a* intersects an outer edge OE of the incident surface electrode 47. The diagonally shaped area in FIG. 4B corresponds to the opening of the collimator portion 61.

The assembly of the electron tube 1 having the above structure will be described next. The semiconductor device 40 is die-bonded to the stem 31. The incident surface electrode 47 is connected to the lead pin 32 by the wire 33. The anode electrode 60 is fixed to the welded flange portion 13 of the case 10 by resistance welding. The welded flange portion 13 is fixed to the stem 31 by resistance welding. The face plate 21 and the stem 31 are set in a vacuum unit called a transfer unit together with the case 10 (these members 21, 31, and 10 are separated) and baked at 300° C. for about 10 hours. Thereafter, the photocathode 22 is formed on one side of the face plate 21. The face plate 21, the stem 31, and the case 10 are integrated in the vacuum atmosphere in this unit. Finally, the vacuum state in the transfer unit is canceled to hold a predetermined vacuum state in the electron tube 1.

As shown in FIGS. 1 and 2, a voltage of −12 kV is applied to the photocathode 22 and the cathode electrode 11 of the electron tube 1, and the anode electrode 60 is grounded (applied with a voltage of 0 V). At this time, the cathode electrode 11 and the anode electrode 60 form an electron lens. Electrons emitted from the photocathode 22 having the effective diameter of 8 mm are focused to a diameter of 1.5 mm smaller than the inner diameter of the collimator portion 62 and the through hole 61 and received by the electron incident surface 44*a* of the semiconductor device 40. In the semiconductor device 40, a voltage of −150 V is applied to the breakdown voltage control layer (anode) 44 of the semiconductor device 40, and the silicon substrate 41 (cathode) is grounded (applied with a voltage of 0 V) such that the p-n junction is reverse-biased. With this structure, the APD 40 obtains an avalanche multiplication gain of about 50.

When light is incident on the electron tube 1, electrons are emitted from the photocathode 22 into the vacuum (inside the electron tube 1). The electrons (photoelectrons) are accelerated and focused by the electron lens and incident on the electron incident surface 44*a* of the APD 40 with an energy of about 12 keV. The incident electrons generate one electron-hole pair every time the electrons lose an energy of 3.6 eV in the APD 40. In this first multiplication process, the electrons are multiplied to about 3,000 times and further 50 times in the subsequent avalanche multiplication process (the avalanche multiplication gain is about 50). The secondary electron gain reaches a total of about 2×105.

In the electron tube 1, the multiplication factor at the first stage is 3,000, i.e., higher than that of the conventional photomultiplier (to be referred to as a "PMT" hereinafter) by about three orders of magnitude. Therefore, detection with a high S/N ratio can be performed. In fact, when about four electrons are emitted from the photocathode 22 on the average upon incidence of very weak pulse light, the electron tube can discriminate the number of input photoelectrons (the number of incident photons), which is beyond the discrimination ability of the conventional PMT. Such characteristics obtained by the electron tube 1 according to the present invention are very effective in quantitative observation of fluorescence emitted from a trace of biosubstance. In addition, it is very important that the electron tube 1 itself stably operates for a long time.

In the electron tube 1 of the first embodiment, a voltage of −150 V is applied from the power supply to the electron incident surface 44*a* of the semiconductor device 40 through the lead pin 32, the wire 33, and the incident surface electrode 47. On the other hand, the anode electrode 60 is grounded (applied with a voltage of 0 V) through the welded flange portion 13. That is, the anode electrode 60 is set at a positive potential with respect to the breakdown voltage control layer 44 of the semiconductor device 40. This means that, since the anode electrode 60 is reverse-biased with respect to the positive ions generated on the electron incident surface 44*a*, the generated positive ions cannot return to the photocathode 22 or the case 10 through the opening portion 61 of the anode electrode 60.

More specifically, since the anode electrode 60 is kept at the positive potential (reverse bias with respect to the positive ions generated on the electron incident surface 44*a*) with respect to the electron incident surface 44*a* in the electron tube 1 according to the present invention, the positive ions generated on the electron incident surface 44*a* cannot return to the insulating portion of the photocathode 22 or the case 10 beyond the anode electrode 60. Since the photocathode 22 of the electron tube 1 is not affected by ion feedback, the photocathode 22 does not degrade even during a long-time operation. In addition, since the positive ions do not return to the insulating portion of the case 10, the case 10 is not charged. The orbits of electrons emitted from the photocathode 22 toward the semiconductor device 40 are not affected by charge, and no pseudo signal is generated by secondary electrons emitted from the case 10. Therefore, the electron tube 1 realizes a very stable operation for a long time.

Assume that ions generated on the electron incident surface 44*a* of the semiconductor device 40 return to the photocathode 22. The positive ions returning to the photocathode 22 have a high energy of about 12 keV because of the potential difference between the photocathode 22 and the electron incident surface 44*a*, so the material of the photocathode 22 is sputtered by the positive ions. Therefore, if ions generated on the electron incident surface 44*a* return to the photocathode 22, the photocathode sensitivity largely degrades during a short-time operation.

Figure 5:
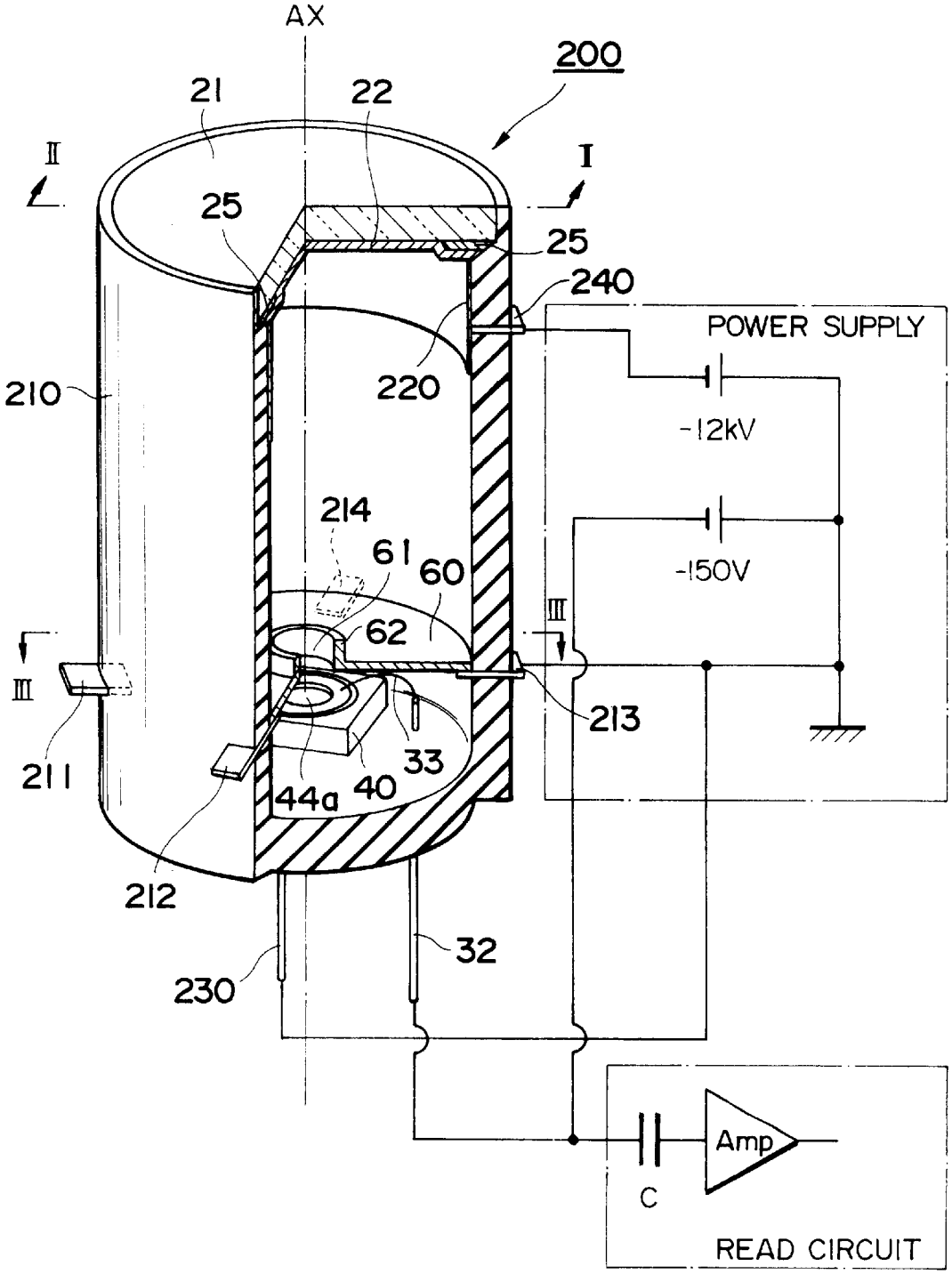
FIG. 5 is a perspective view (partially cutaway view) showing the structure of an electron tube according to the second embodiment of the present invention.
Figure 6A:
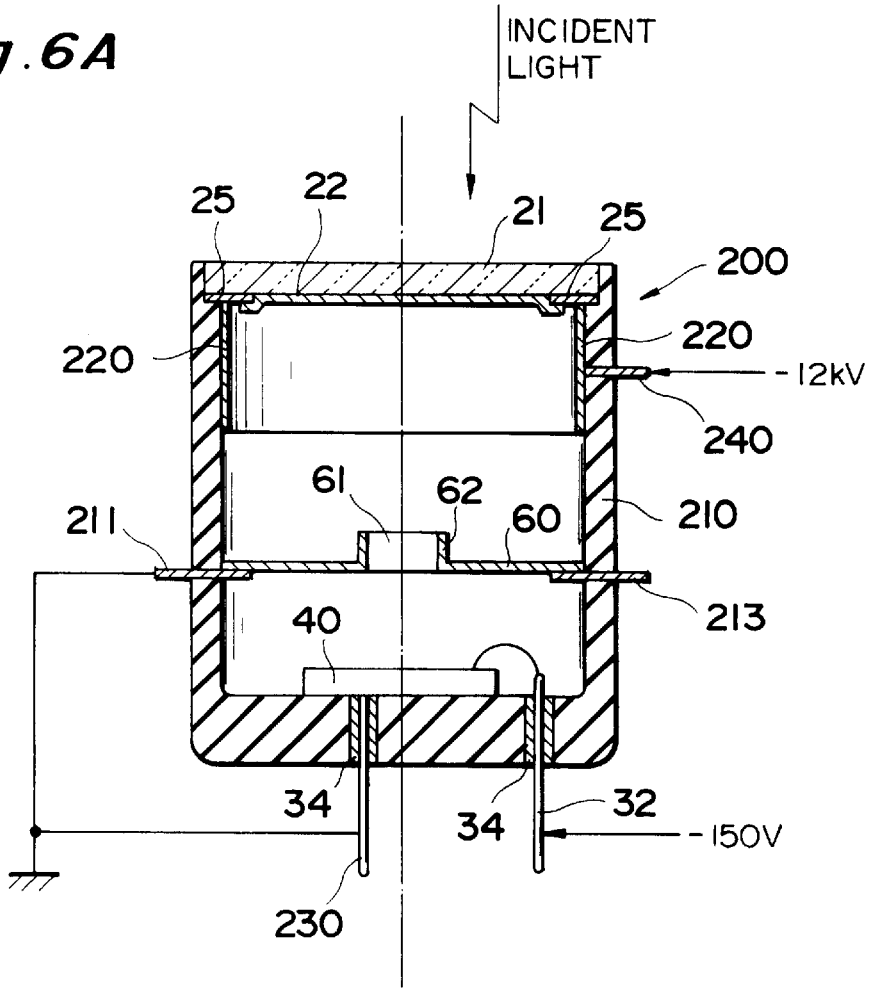
Figure 6B:
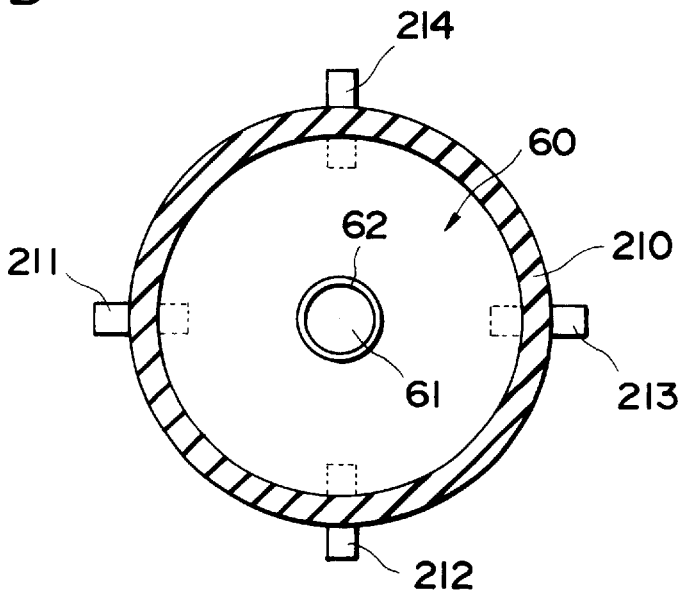
FIG. 6B is a sectional view of the electron tube of the second embodiment taken along a line III—III in FIG. 5.

Next, FIGS. 5, 6A and 6B are a perspective view and sectional views, respectively, showing an electron tube according to the second embodiment of the present invention. Particularly, the sectional views in FIGS. 6A and 6B respectively show the sections of the electron tube taken along lines II—II and III—III in FIG. 5. Only differences from the first embodiment will be described below. The same reference numerals denote the same parts throughout the drawings, and a detailed description thereof will be omitted.

As shown in FIGS. 5 and 6A, the electron tube 200 of the second embodiment is characterized in that an envelope type case 210 of ceramic material is used. The face plate 21 with the photocathode 22 and the photocathode electrode 25, the anode electrode 60 with the collimator portion 62 having a through hole 61, and the semiconductor device 40 with an electron incident surface 44*a* are arranged along the case axis AX. The case 210 has an opening on which the face plate 21 is supported, and a conductive film 220 of aluminum as a cathode electrode is provided on an inner wall of the case 210. Thereby, the photocathode 22 on the face plate 21 is electrically connected to the cathode electrode 220 via a photocathode electrode 25. Further, an electrode terminal 240 is fixed at the side wall of the case 210 while a part of the electrode terminal 240 passes through the side wall. The electrode terminal 240, the cathode electrode 220, the photocathode electrode 25 and the photocathode 22 are electrically connected to each other, and thereby the power supply can applies a voltage of −12 kV to the photocathode 22 via these conductive members 25, 220 and 240. The anode electrode 60 is accommodated in the case 210 and supported by four electrode terminals 211 to 214 as shown in FIG. 6B. The anode electrode 60 is electrically connected to these terminals 211 to 214, and thereby the anode electrode 60 is set at a grounded level (0 V). On the other hand, the semiconductor device 40 is mounted on an inner bottom surface of the case 210 so as to sandwich the anode electrode 60 together with the photocathode 22. The semiconductor device 40 has a same structure as FIGS. 3.

Lead pins 32 and 230 are insulated by glass 34 is fixed to the bottom of the case 210 while each of parts of these pins 32 and 230 passes through the bottom. The lead pin 32 is connected to the incident surface electrode of the semiconductor device 40 through a wire 33 and the power supply applies a voltage of −150 V to the electron incident surface 44*a* via the lead pin 32. The lead pin 230 is electrically connected to a n-type substrate of the semiconductor device 40, and is set a grounded level (0 V). Thereby, the lead pin 230 and the anode electrode 60 are set a same potential.

Also, in the second embodiment, the size of the opening, which faces the semiconductor device 40, of collimator portion 62 of the anode electrode 60 satisfies to be equal to or smaller than that of the electron incident surface 44*a* of the semiconductor device 40 as shown in FIG. 4A. Further, since the incident surface electrode having an opening that defines the electron incident surface 44*a* is apart from a peripheral electrode through a gap (see FIGS. 3, 4A and 4B), the size of the opening of the anode electrode 60 as a confining mechanism can be confined by the structural relationship between the anode electrode 60 and the incident surface electrode. In this arrangement, it is preferably that, as shown in FIG. 4B, the maximum diameter of the opening, which faces the semiconductor device 40, of collimator portion 62 of the anode electrode 60 satisfies to be equal to or smaller than the minimum outer diameter of the incident surface electrode. The minimum outer diameter of the incident surface electrode is defined by a minimum distance Lm between intersections CX1 and CX2 where a line passing through the center O of the electron incident surface 44*a* intersects an outer edge OE of the incident surface electrode of the semiconductor device 40.

An electron tube 100 according to the third embodiment of the present invention will be described below with reference to FIGS. 7 to 10. Only differences from the first embodiment will be described below. The same reference numerals denote the same parts throughout the drawings, and a detailed description thereof will be omitted.

Figure 7:
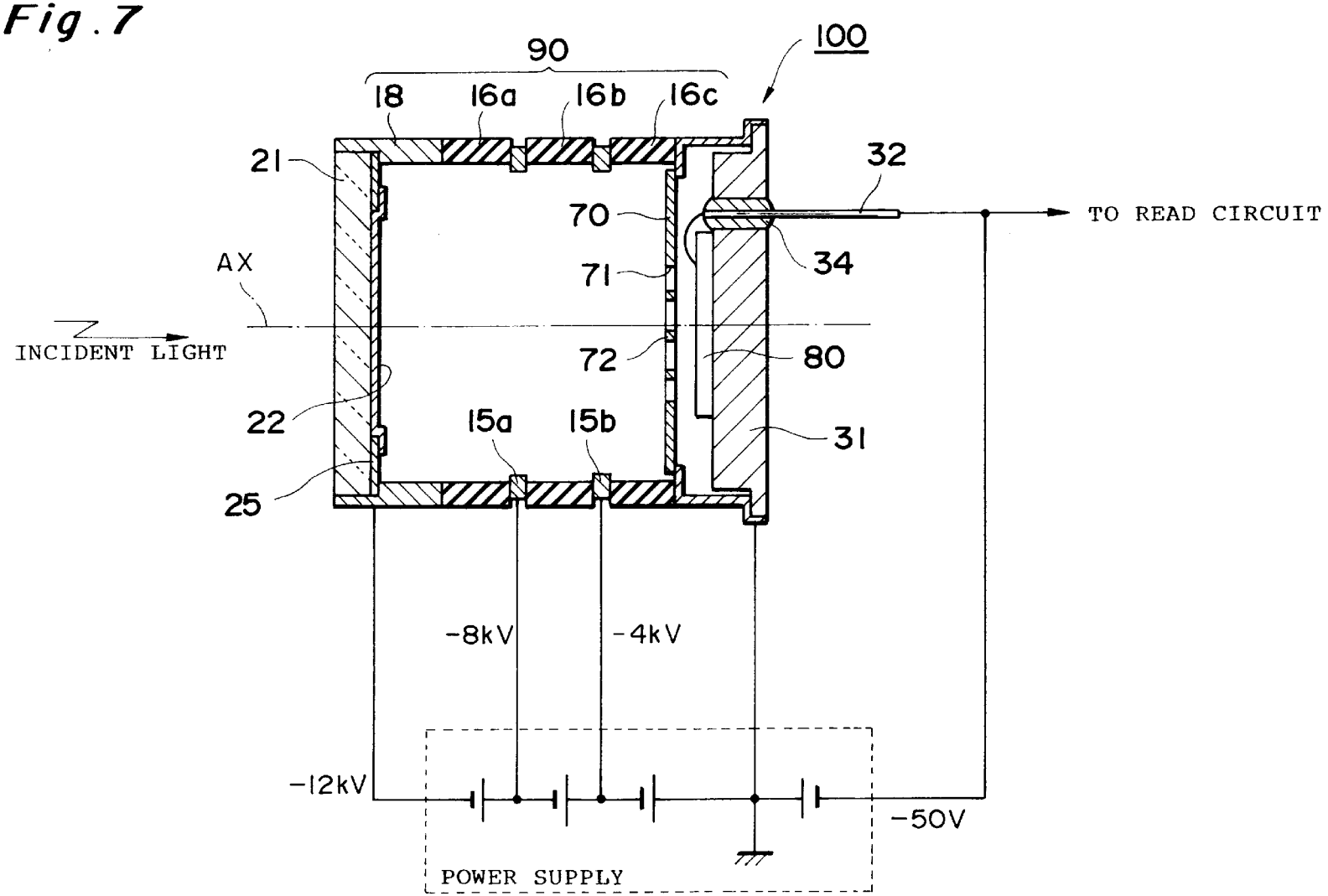
FIG. 7 is a sectional view showing the structure of an electron tube according to the third embodiment of the present invention, which corresponds to the sectional view (FIG. 2) taken along the line I—I in FIG. 1.
Figure 8:
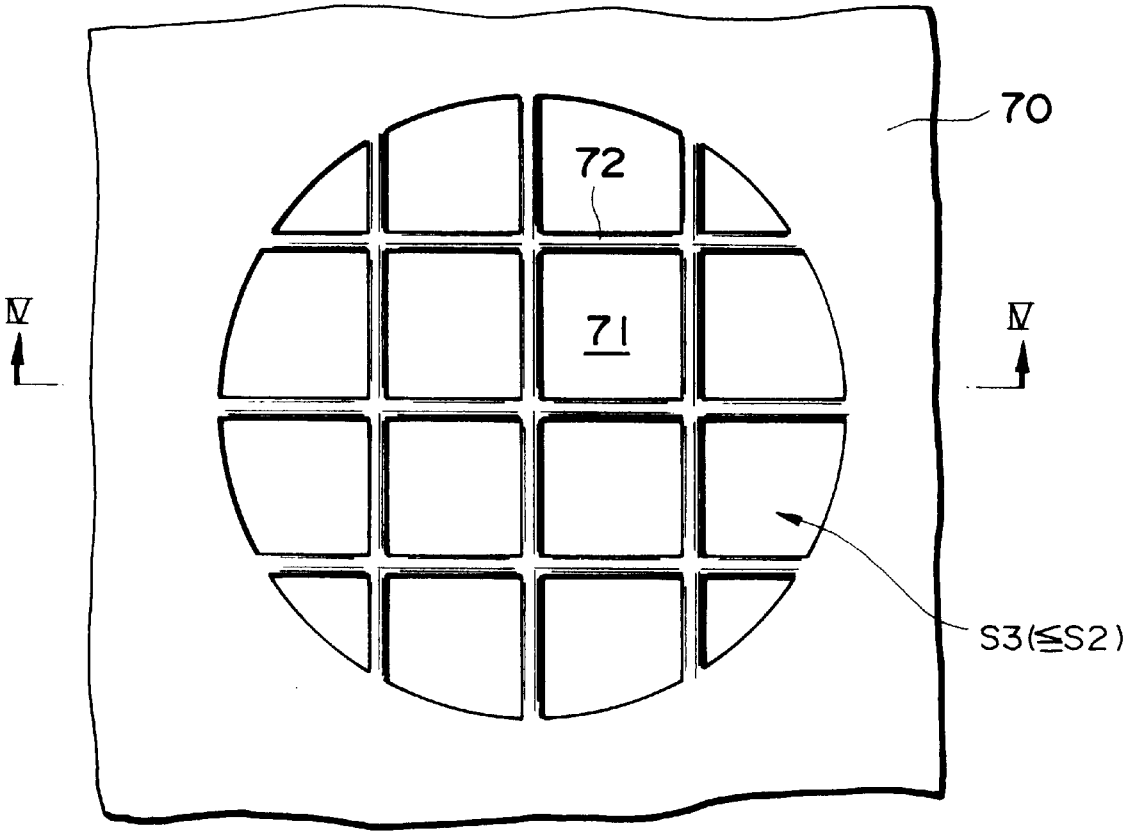
FIG. 8 is a plan view showing the structure of a mesh electrode arranged in the through hole of an anode electrode.

As shown in FIG. 7, a cathode electrode 18 is as short as about 2 mm. At the central portion of a case 90, intermediate flanges 15*a* and 15*b* are inserted between insulating rings (included in a pipe type container) 16*a*, 16*b*, and 16*c*. A PD having a large electron incident surface area is used as a semiconductor device 80. A large through hole 71 is formed in an anode electrode 70. A mesh electrode 72 shown in FIG. 8 is arranged in the through hole 71. By shortening the cathode electrode 18, an electron lens for guiding electrons which are emitted from a photocathode 22 and rarely focused to the semiconductor device 80 can be constituted. More specifically, the electron tube 100 is assumed to be used in a strong magnetic field of about 2 T (tesla) along a tube axis AX passing through the center of the case 90.

Figure 10:
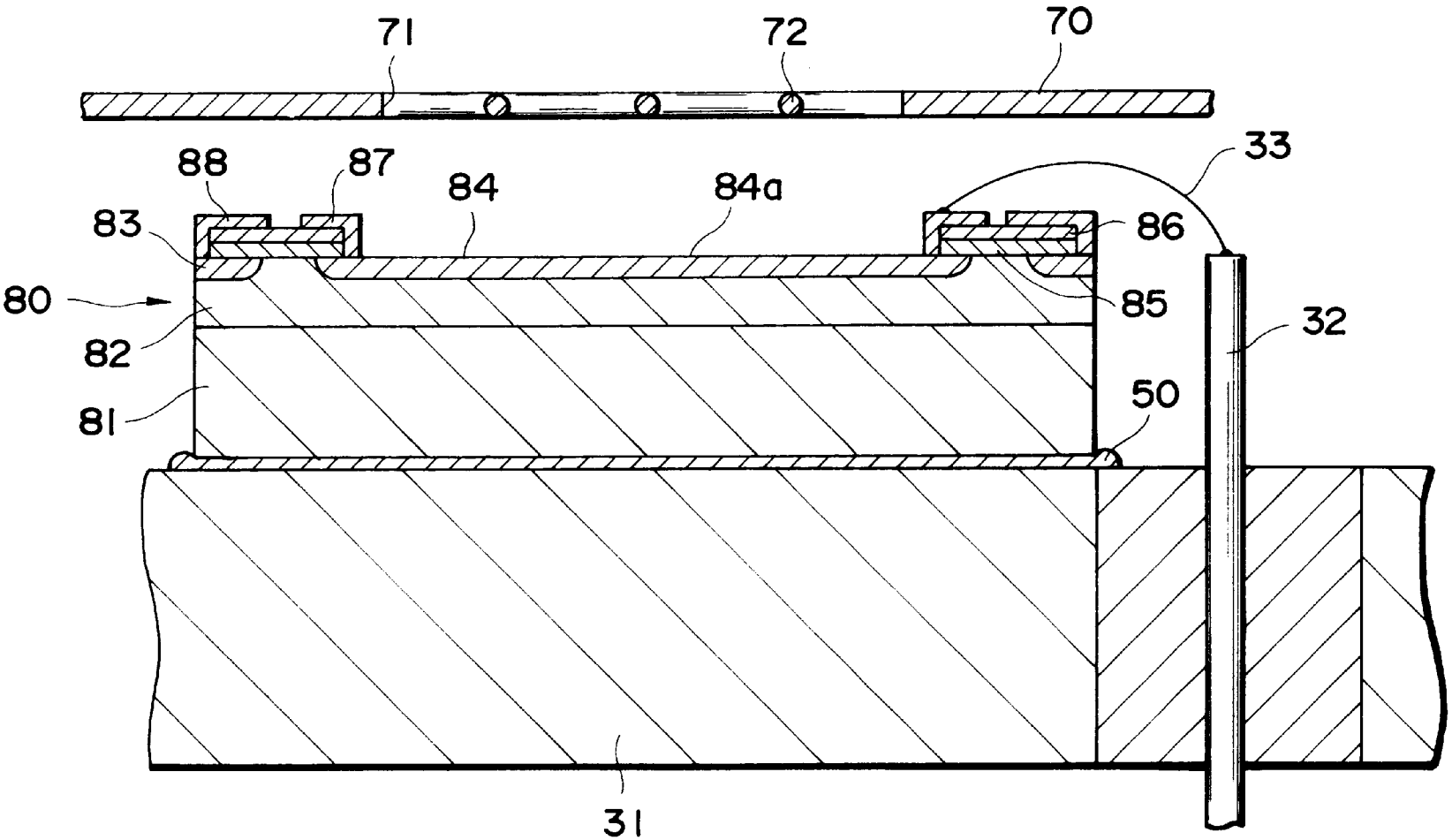
FIG. 10 is a sectional view showing the detailed structure near a semiconductor device in the electron tube shown in FIG. 8.

Since, in such a strong magnetic field, the propagation direction of electrons is determined by the direction of the magnetic field, the electric field can be used to just accelerate the electrons. More specifically, no electron lens can be formed by the electric field, and the substantial effective diameter of the photocathode 22 is limited by the opening portion 71 of the anode electrode 70 or an electron incident surface 84*a* (to be described later; FIG. 10) of the semiconductor device 80. To ensure the maximum effective diameter of the photocathode 22, both the anode electrode 70 having the large through hole 71 and the semiconductor device 80 having the large electron incident surface 84*a* are required. This use condition is required for a high-energy experiment or the like using an accelerator. However, in the third embodiment as well, an area S3 of the stem-side opening of the through hole 71 is preferably equal to or smaller than an area S2 of the electron incident surface 84*a* (FIGS. 4A and 8).

The intermediate flanges 15*a* and 15*b* arranged in the case 90 function to suppress the unstable state due to charge of the case 90. Voltages obtained by uniformly distributing a voltage of −12 kV applied to the photocathode 22, i.e., voltages of −8 kV and −4 kV are applied to the intermediate flanges 15*a* and 15*b*, respectively.

Figure 9:
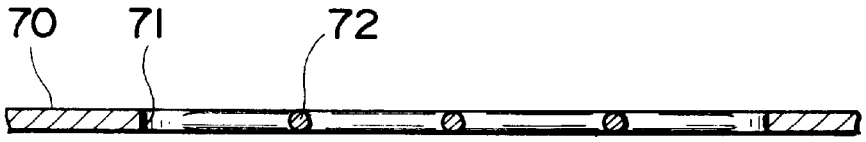
FIG. 9 is a sectional view of the anode electrode shown in FIG. 8 taken along a line IV—IV in FIG. 8.

As shown in FIGS. 8 and 9, the mesh electrode 72 is arranged in the through hole 71 of the anode electrode 70. The mesh electrode 72 is formed by partially etching the anode electrode 70 made of stainless steel. In this case, the line width of the mesh electrode 72 is 50 $\mu$m, and the pitch is 1.5 mm. Electrons are transmitted through the mesh electrode 72 in correspondence with the opening ratio (93%) of the mesh electrode 72.

The mesh electrode 72 is arranged in the through hole 71 of the anode electrode 70 because the through hole 71 of the anode electrode 70 is made large in correspondence with the electron incident surface 84*a* of the semiconductor device 80. More specifically, when the through hole 71 of the anode electrode 70 is made large, the valley of the negative potential on the side of the photocathode 22 extends to the side of the stem 31 through the through hole 71. This degrades the effect of suppressing feedback of positive ions generated on the electron incident surface 84*a* of the semiconductor device 80. When the mesh electrode 72 is added, the negative potential from the photocathode 22 can be prevented from extending to the side of the electron incident surface 84*a,* so that the ion feedback suppressing effect can be maintained. The maximum diameter of the through hole 71 of the anode electrode 70 is equal to or smaller than the electron incident surface 84*a* of the PD 80 (S3<S2).

As shown in FIG. 10, the semiconductor device 80, i.e., the PD uses, as the substrate material, a diffusion wafer obtained by heavily and deeply diffusing phosphorus as an n-type impurity from the lower surface of a high-resistance n-type wafer. Therefore, the diffusion wafer is constituted by a heavily doped n-type contact layer 81 formed on the lower surface and a high-resistance n-type layer 82. An n-type channel stop layer 83 is formed by heavily ion-implanting phosphorus in the peripheral portion of the surface of the high-resistance n-type layer 82. A disk-shaped p-type incident surface layer (breakdown voltage control layer) 84 is formed by heavily diffusing boron at the central portion of surface of the layer 82. An oxide film 85 and a nitride film 86 are formed so as to cover the surface of the channel stop layer 83 and the peripheral portion of the incident surface layer 84. An incident surface electrode 87 consisting of an aluminum film is formed to contact the incident surface layer 84 and apply a voltage to the incident surface layer 84. A charge prevention electrode 88 consisting of an aluminum film contacting the channel stop layer 83 is formed at a position separated from the incident surface electrode 87. The electron incident surface 84*a* of the PD 80 is substantially defined by the inner diameter of the incident surface electrode 87. Also, in the third embodiment, a gap between the electrodes 87 and 88 exists and the nitride film 86 is exposed from the gap. Therefore, in order to prevent that undesirable photoelectrons arrive at the nitride film 86, the through hole 71 of the anode electrode 70 preferably has a maximum inner diameter equal to or smaller than the minimum outer diameter of the incident surface electrode 87. In other words, assume the electrode 87 corresponds to the electrode 47 in FIG. 3, the electrode 88 corresponds to the electrode 48 in FIG. 3, the nitride film 86 corresponds to the film 46 in FIG. 3, the through hole 71 corresponds to the hole 61 in FIG. 3, the anode electrode 70 corresponds to the electrode 60 in FIG. 3, and the electron incident surface 84*a* corresponds to the surface 44*a* in FIG. 3, it can be understood that the minimum outer diameter of the incident surface electrode 87 having an opening which defines the electron incident surface 84*a* is defined by a minimum distance Lm between intersections CX1 and CX2 where a line passing through the center O of the electron incident surface 84*a* intersects an outer edge OE of the incident surface electrode 87, as shown in FIG. 4B.

A voltage of −12 kV is applied to the photocathode 22 of the electron tube 100, and a voltage of 0 V is applied to the anode electrode 70. Since the contact layer 81 of the semiconductor device 80 is at the same potential as that of the anode electrode 70, the contact layer 81 is applied with the voltage of 0 V. The electron incident surface 84*a* is applied with a voltage of −50 V through the lead pin 32, the wire 33, and the incident surface electrode 87. The operation of the electron tube 100 upon incidence of light is the same as in the first embodiment. By arranging the mesh electrode 72 in the through hole 71, ion feedback can be appropriately suppressed even when the through hole 71 of the anode electrode 70 is made large. More specifically, even when the through hole 71 of the anode electrode 70 is made large, extension of the electric field can be suppressed, i.e., the valley of the low potential from the photocathode 22 which is biased to the negative potential can be prevented from entering the side of the electron incident surface 84*a* through the through hole 71 of the grounded anode electrode 70 in the presence of the mesh electrode 72. For this reason, gas molecules ionized on the electron incident surface 84*a* upon incidence of electrons can be effectively prevented from returning to the photocathode 22 or the case 90 through the through hole 71.

Since the light-receiving surface of the face plate 21 is large, the electron tube 100 of the third embodiment stably operates in a high magnetic field for a long time and is used for a high-energy experiment using an accelerator.

Figure 11:
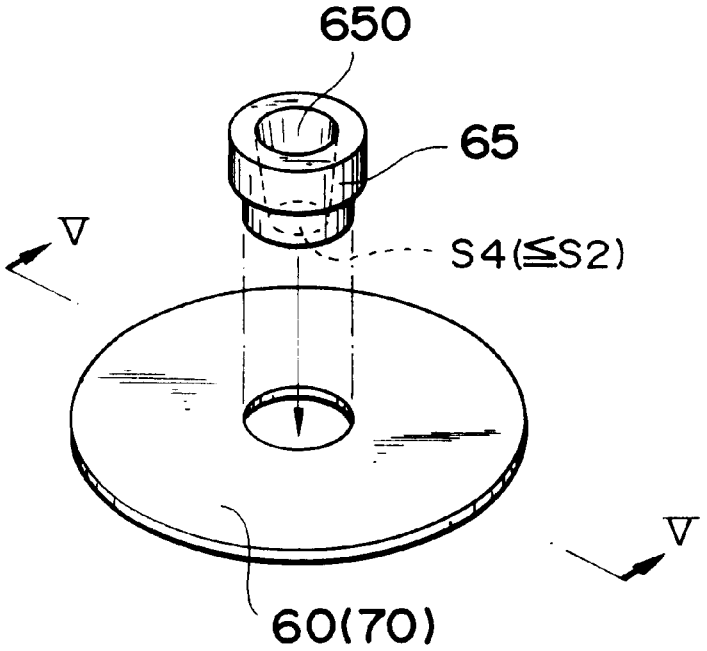
FIG. 11 is a view showing the process of assembling a collimator electrode supported by the anode electrode (fourth embodiment)
Figure 12:
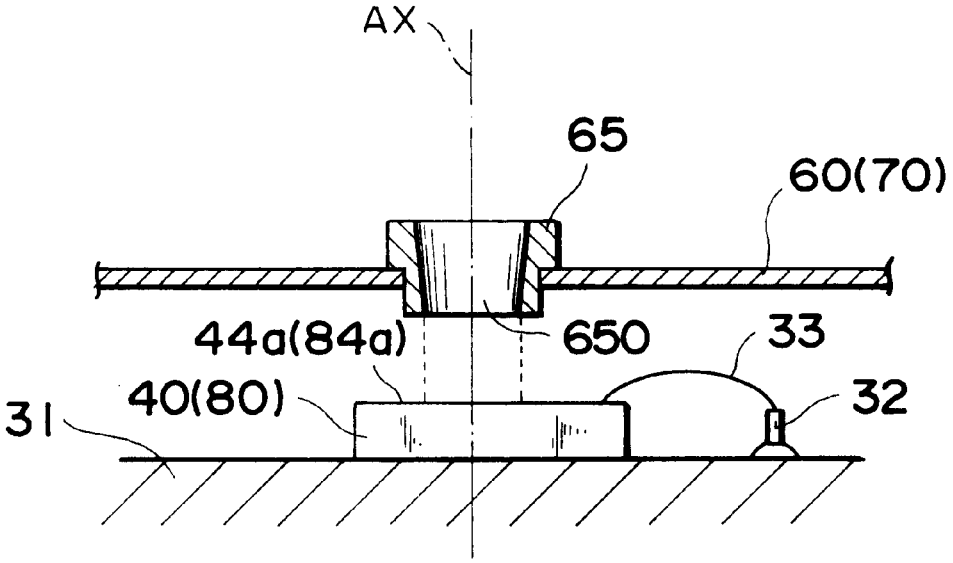
FIG. 12 is a sectional view of the anode electrode and the collimator electrode shown in FIG. 11 taken along a line V—V in FIG. 11.

An electron tube according to the fourth embodiment of the present invention has a collimator electrode 65 supported by an anode electrode 60 (70), as shown in FIGS. 11 and 12. The collimator portion 62 in the first embodiment differs from the collimator electrode 65 in the fourth embodiment in the following point. The collimator portion 62 is integrated with the anode electrode 60 (70) to constitute part of the anode electrode 60 (70) while the collimator electrode 65 is a conductive ring member directly attached to the anode electrode 60 (70). Therefore, the collimator portion 62 and the collimator electrode 65 have no functional difference therebetween. The collimator electrode 65 forms an electric field for returning photoelectrons $e^-$ which are emitted from the peripheral portion of a photocathode 22 to be obliquely incident on a semiconductor device 40 toward a tube axis AX (the tube axis AX corresponds to the direction of light incidence). With this structure, the photoelectrons $e^-$ emitted from the entire region in the photocathode 22 uniformly lose the energy in the dead layer of the semiconductor device 40. For this reason, the electron tube can maintain a high ability of discriminating the number of electrons. Note that the structure of the fourth embodiment can be applied to both electron tubes of the first to third embodiments shown in FIGS. 1, 2, 5, 6A and 7.

To further increase the above effect, the sectional area (the area of a through hole 650 defined by a plane perpendicular to the tube axis AX) of the through hole 650 of the collimator electrode 65 reduces from the photocathode 22 toward a stem 31, as shown in FIG. 12. In other words, the area of the photoelectric-surface-side opening of the through hole 650 of the collimator electrode 65 is larger than that of the stem-side opening of the through hole 650 of the collimator electrode 65.

The structural relationship between the collimator electrode 65 and an electron incident surface 44*a* (84*a*) of the semiconductor device 40 (80) will be described. An area S4 of the stem-side opening of the through hole 650 of the collimator electrode 65 is preferably equal to or smaller than an area S2 of the electron incident surface 44*a* (84*a*) of the semiconductor device 40 (80) (FIGS. 4A and 11). That is, the region for receiving the electrons emitted from the photocathode 22 has an area equal to or smaller than the effective area of the electron incident surface 44*a* (84*a*) of the semiconductor device 40 (80). With this structure, electrons accidentally emitted from portions other than the photocathode 22 are never incident on portions other than the electron incident surface of the semiconductor device 40 (80) to degrade the semiconductor device 40 (80) itself (degradation due to electron bombardment) or result in unnecessary charge. Also, in the fourth embodiment, since the semiconductor device 40 (80) has a gap between the electrodes and thereby the insulator (nitride film) is exposed from the gap, the stem-side opening of the through hole 650 of the collimator electrode 65 preferably has a maximum inner diameter equal to or smaller than the minimum outer diameter of the electrode having an opening that defines the electron incident surface 44*a* (84*a*) (FIG. 4B). As sown in FIG. 4B, the minimum outer diameter of the electrode having an opening which defines the electron incident surface 44*a* (84*a*) is defined by a minimum distance Lm between intersections CX1 and CX2 where a line passing through the center O of the electron incident surface 44*a* (84*a*) intersects an outer edge OE of the electrode.

When the collimator electrode 65 has a total length of 3.5 mm, the diameter of the photoelectric-surface-side opening of the through hole 650 is preferably 3 mm, and the diameter of the stem-side opening of the through hole 650 is preferably 2 mm. (At this time, the area of the stem-side opening is set to be smaller than that of the electron incident surface of the semiconductor device 40 (80)).

According to the present invention, for the opening of the confining mechanism arranged between the photocathode and the semiconductor device, e.g., the area of the stem-side opening of the through hole of the anode electrode is set to be smaller than the incident area of the electron incident surface of the semiconductor device. In addition, in the semiconductor device having the p-type electron incident surface and the n-type substrate, the n-type substrate is electrically connected to the stem to set the anode electrode at the same potential as that of the stem, and the semiconductor device is reverse-biased. With this structure, an electron tube which enables a stable operation for a long time can be realized.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The basic Japanese Application No. 128723/1996 filed on May 23, 1996, and 111656/1996 filed on May 2, 1996 are hereby incorporated by reference.

What is claimed is:

1. An electron tube comprising:

a photocathode provided so as to emit photoelectrons in correspondence with incident light;

a semiconductor device having an electron incident surface for receiving the photoelectrons from said photocathode, said semiconductor device being arranged such that its electron incident surface faces said photocathode; and a confining mechanism provided between said photocathode and said semiconductor device so as to confine a spread of the photoelectrons from said photocathode, said confining mechanism having an, opening for passing through the photoelectrons from said photocathode toward said electron incident surface, wherein said opening of said confining mechanism has an area not greater than that of said electron incident surface of said semiconductor device.

2. A tube according to claim 1, further comprising:

a container being a hollow member which has a first opening and a second opening opposing said first opening, said photocathode provided on the first opening side of said container; and a stem provided an the second opening side of said container so as to define a distance between said photocathode and said electron incident surface.

3. A tube according to claim 1, further comprising an envelope having an opening for supporting said photocathode at a predetermined position and accommodating said confining mechanism such that said semiconductor device is positioned between said confining mechanism and an inner bottom surface of said envelope.

4. A tube according to claim 1, further comprising:

a cathode electrode provided so as to apply a predetermined voltage to said photocathode; and an anode electrode provided between said photocathode and said semiconductor device, said anode electrode having a first surface facing said photocathode, a second surface opposing said first surface, and a through hole extending from said first surface to said second surface; and wherein said confining mechanism includes said anode electrode, and said opening of said confining mechanism is defined by a second-surface-side opening of said through hole of said anode electrode.

5. A tube according to claim 4, further comprising a mesh electrode provided in the through hole of said anode electrode.

6. A tube according to claim 4, wherein said anode electrode has a collimator portion which extends from said first surface to said photocathode while surrounding a first-surface-side opening of said through hole of said anode electrode.

7. A tube according to claim 1, further comprising:

a cathode electrode provided so as to apply a predetermined voltage to said photocathode;

an anode electrode provided between said photocathode and said semiconductor device, said anode electrode having a through hole for passing through the photoelectrons from said photocathode toward said electron incident surface of said semiconductor device; and a collimator electrode supported by said anode electrode, said collimator electrode having a third surface lacing said photocathode, a fourth surface opposing said third surface, and a through hole extending from said third surface to said fourth surface; and wherein said confining mechanism includes said collimator electrode, and said opening of said confining mechanism is defined by a fourth-surface-side opening of said through bole of said collimator electrode.

8. A tube according to claim 1, wherein said semiconductor device has an n-type substrate and a p-type semiconductor layer formed on said n-type semiconductor substrate and having said electron incident surface.

9. An electron tube comprising:

a photocathode provided so as to emit photoelectrons in correspondence with incident light;

a semiconductor device having an electron incident surface for receiving the photoelectrons from said photocathode and an incident surface electrode having an opening which dees said electron incident surface, said semiconductor being arranged such that its electron incident surface faces said photocathode, and a confining mechanism provided between said photocathode and said electron incident surface of said semiconductor device so as to confine a spread of the photoelectrons from said photocathode, said confining mechanism having an opening for passing through the photoelectrons from said photocathode toward said electron incident surface, wherein said opening of said confining mechanism has a maximum inner diameter not greater than a minimum outer diameter of said incident surface electrode of said semiconductor device, said minimum outer diameter of said incident surface electrode being defined by a minimum distance between intersections where a line passing through a center of said electron incident surface intersects an outer edge of said incident surface electrode.

10. A tube according to claim 9, further comprising:

a container being a hallow member which has a first opening and a second opening opposing maid first opening, said photocathode provided on the first opening side of said container; and a stem provided on the second opening side of said container so as to define a distance between said photocathode and said electron incident surface.

11. A tube according to claim 9, further comprising an envelope having an opening for supporting said photocathode at a predetermined position and accommodating said confining mechanism such that said semiconductor device is positioned between said confining mechanism and an inner bottom surface of said envelope.

12. A tube according to claim 9, further comprising:

a cathode electrode provided so as to apply a predetermined voltage to said photocathode; and an anode electrode provided between said photocathode and said semiconductor device, said anode electrode having a first surface facing said photocathode, a second surface opposing said first surface, and a through hole extending from said first surface to said second surface; and wherein said confining mechanism includes said anode electrode, and said opening of said confining mechanism is defined by a second-surface-side opening of said through hole of said anode electrode.

13. A tube according to claim 12, further comprising a mesh electrode provided in the through hole of said anode electrode.

14. A tube according to claim 12, wherein said anode electrode has a collimator portion which extends from said first surface to said photocathode while surrounding a first-surface-side opening of said through hole of said anode electrode.

15. A tube according to claim 9, further comprising:

a cathode electrode provided so as to apply a predetermined voltage to said photocathode;

an anode electrode provided between said photocathode and said semiconductor device, said anode electrode having a through bole for passing through the photoelectrons from said photocathode toward said electron incident surface of said semiconductor device; and a collimator electrode supported by said anode electrode, said collimator electrode having a third surface Lacing said photocathode, a fourth surface opposing said third surface, and a through hole extending from said third surface to said fourth surface; and wherein said confining mechanism includes said collimator electrode, and said opening of said confining mechanism is defined by a fourth-surface-side opening of said through hole of said collimator electrode.

16. A tube according to claim 9, wherein said semiconductor device has an n-type substrate and a p-type semiconductor layer formed on said n-type semiconductor substrate and having said electron incident surface.

* * * * *